United States Patent [19]

Berntsson

[11] Patent Number: 5,048,454

[45] Date of Patent: Sep. 17, 1991

[54] DEVICE FOR APPLICATION OF GLUE STRIPS

[76] Inventor: Reinhold Berntsson, Jordal 8775, S-444 00 Stenungsund, Sweden

[21] Appl. No.: 469,482

[22] PCT Filed: Oct. 17, 1988

[86] PCT No.: PCT/SE88/00541

§ 371 Date: Apr. 11, 1990

§ 102(e) Date: Apr. 11, 1990

[87] PCT Pub. No.: WO89/03252

PCT Pub. Date: Apr. 20, 1989

[30] Foreign Application Priority Data

Oct. 16, 1987 [SE] Sweden ..... 8704038

[51] Int. Cl.[5] ..... B05B 15/02; B05C 5/02

[52] U.S. Cl. ..... 118/302; 118/325; 222/148; 239/112; 239/119; 239/413; 239/434; 239/585

[58] Field of Search ..... 118/300, 302, 325; 239/106, 112, 119, 412, 413, 429, 434, 585, DIG. 11; 222/148

[56] References Cited

U.S. PATENT DOCUMENTS

| | | | |
|---|---|---|---|
| 3,481,542 | 12/1969 | Huber | 239/585 |
| 3,770,209 | 11/1973 | Wilcox | 239/434 |
| 3,850,371 | 11/1974 | Trapp | 239/119 |

FOREIGN PATENT DOCUMENTS

| | | | |
|---|---|---|---|
| 713683 | 11/1941 | Fed. Rep. of Germany | 239/412 |
| 1482372 | 5/1969 | Fed. Rep. of Germany | 239/413 |
| 3535438 | 4/1987 | Fed. Rep. of Germany | 239/585 |

*Primary Examiner*—Michael Wityshyn

*Attorney, Agent, or Firm*—Ostrolenk, Faber, Gerb & Soffen

[57] ABSTRACT

A device for application of a glue strip on a movable paper web by means of at least one glue sprayer for glue under pressure. The device incoporates a valve housing (12) for two diaphragm-magnetic valves (13, 14) or the like, the spring loaded rubber diaphragms (23, 24) of which are provided between one inlet chamber (19, 20) and one outlet channel (21, 22) each, intended for glue and for a rinsing liquid respectively. The outlet channels (21, 22) are interconnected and adapted to open into a common nozzle (31) with a fine outlet opening (32) located at some distance from the paper web (35). The piston (27, 28) of each magnetic valve (13, 14) acting upon the rubber diaphragm (23, 24) has a very short stroke.

5 Claims, 3 Drawing Sheets

DEVICE FOR APPLICATION OF GLUE STRIPS

The present invention refers to a device for application of a glue strip on a movable paper web by means of at least one glue sprayer for glue under pressure.

BACKGROUND OF THE INVENTION

Multi page prints produced in a printing press are nowadays glued in ever increasing extent instead of being stitched. Such prints, such as newspapers, magazines, brochures etc. are back or joint glued intermittently or continuously in the transport direction of the printing path. Gluing of the print directly in the printing press provides a number of advantages, i.e. lower production costs, higher flexibility concerning odd dimensions and number of sides, better final products (no loose pages), and a facilitated recovery of the paper, as there are no staples, which first would have to be removed.

Joint glueing machines are known per se, but they do not fullfil the requirements from highly efficient rotary printing machines.

PURPOSE AND MOST ESSENTIAL FEATURES OF THE INVENTION

The purpose of the present invention is to provide an intermittent gluing device wherein the length, width and location of the glue strip along the dividing line of the print shall be variable quite arbitrarily in accordance with the wishes of the user, and in dependence of which product shall be produced in the the printing machine. The plant shall be fully automated, which means that it starts and stops in accordance with a predetermined program, that it emits distinct strips of glue without any late dripping and that the jet nozzles are automatically rinsed after commenced printing. The plant shall be easy to handle, no specialist knowledge shall be required for changing programmable functions. Putting in service and maintenance shall be possible to effect automatically or with a minimum of work by the user. The installation shall be easy to make and no influence upon the other functions of the printing machine are allowed. The plant furthermore shall be compatible with all printing presses available on the market.

These tasks have been solved in that the device incorporates a valve housing for two diaphragm-magnetic valves or the like, the spring loaded rubber diaphragms of which are provided between one inlet chamber and one outlet channel each, intended for glue and for a rinsing liquid resp., that the outlet channels are interconnected and adapted to open into a common nozzle with a fine outlet opening located at some distance from the paper track, and that the piston of each magnetic valve acting upon the rubber diaphragm has a very short stroke.

DESCRIPTION OF THE DRAWINGS

The invention hereinafter will be further described in an embodiment with reference to the accompanying drawings.

DESCRIPTION OF THE EMBODIMENTS

Figure 1:
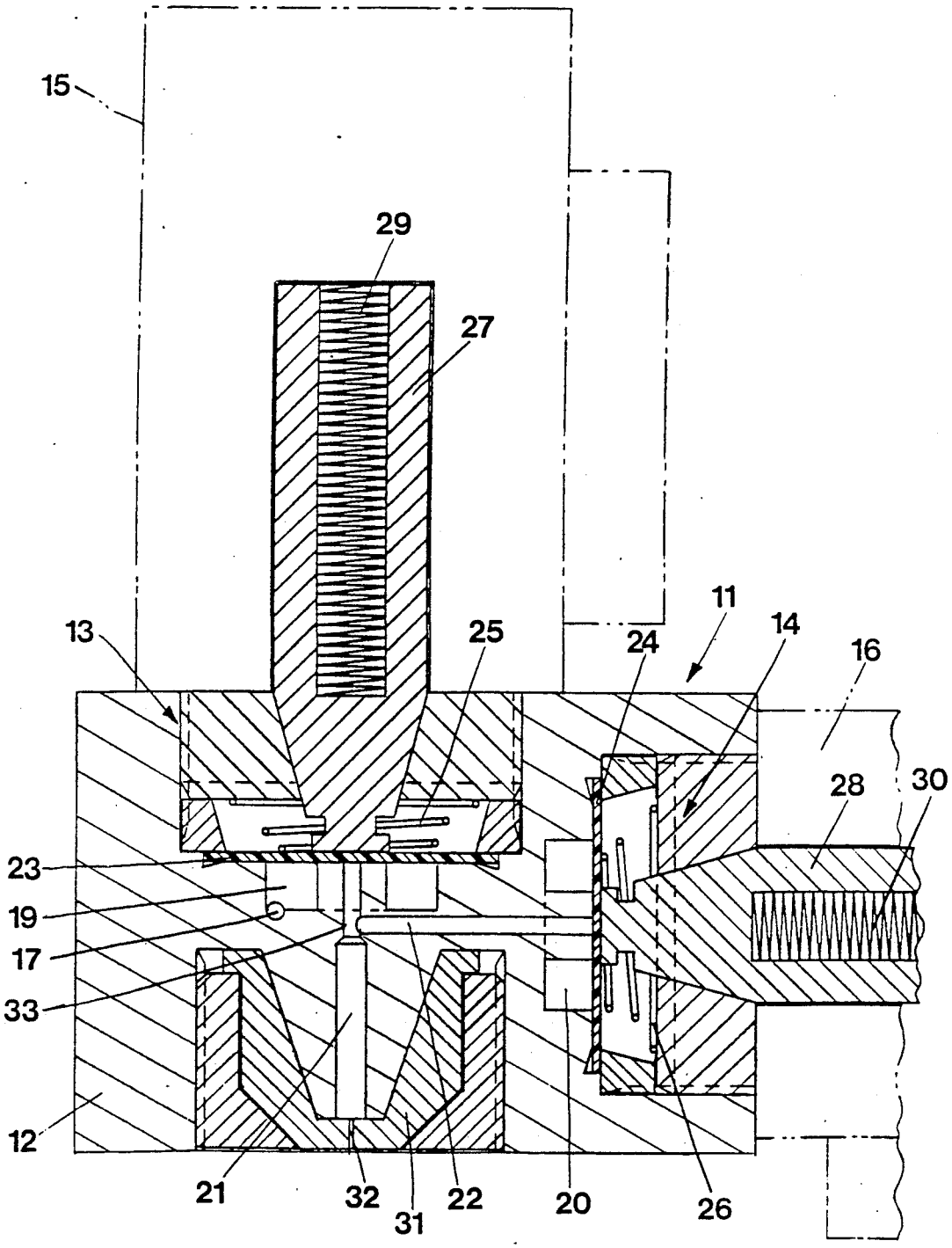
FIG. 1 shows a section through a glue sprayer according to the invention in exaggerated size.
Figure 2:
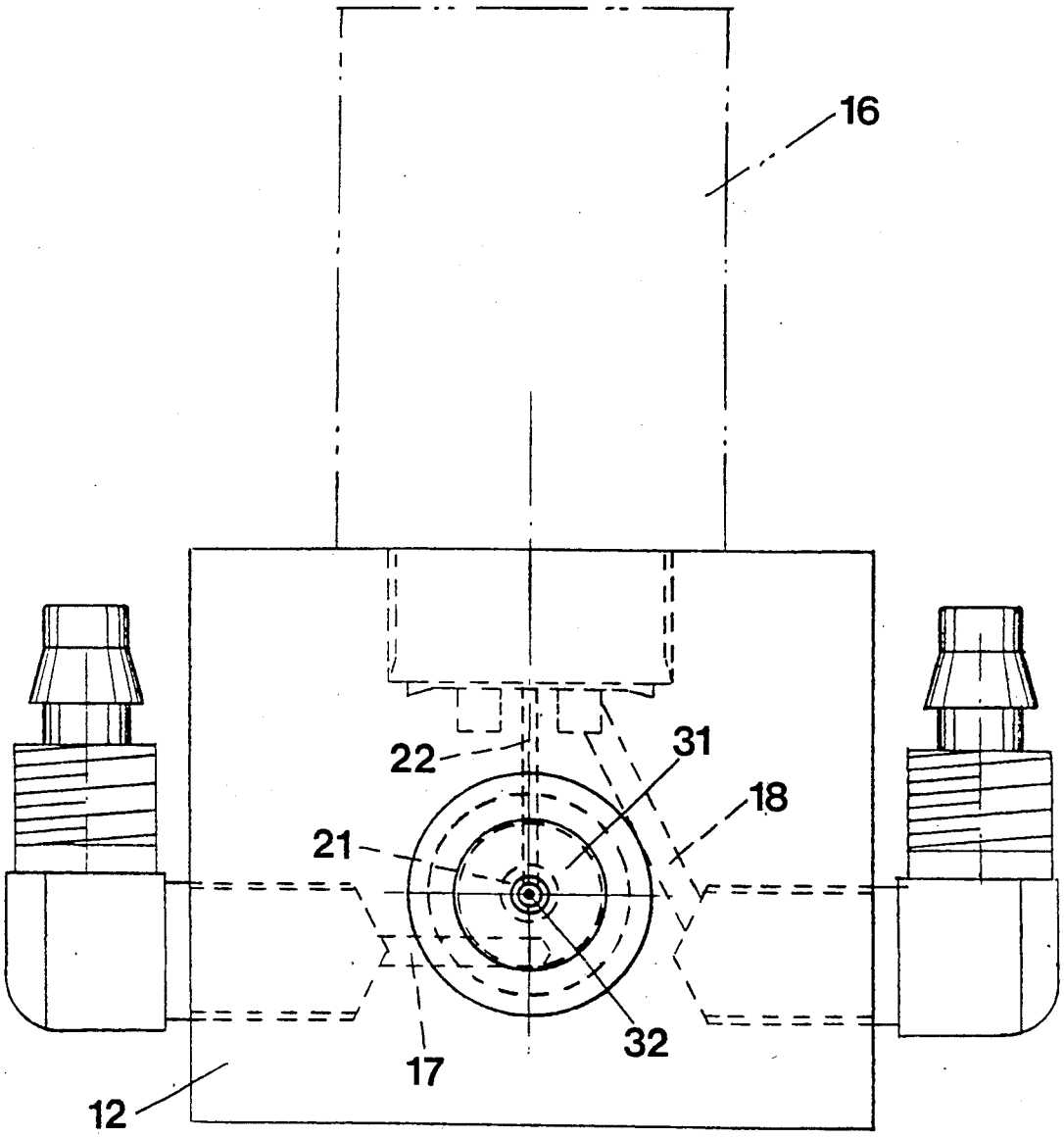
FIG. 2 shows the glue sprayer according to FIG. 1 in a view from below, i.e. the side where the nozzle is provided.

The glue spraying device according to the invention, designated 11, incorporates a valve housing 12 in which is provided two diaphragm valves 13 and 14, each of which is actuated by one electromagnet 15 and 16 resp. Each valve 13, 14 incorporates an inlet channel 17, 18 for one medium each, one annular inlet chamber 19, 20 and one outlet channel 21 and 22 each. The inlet channel 17 of the valve 13 is intended to be connected to a glue tank, which is not further shown, whereas the inlet channel 18 of the valve 14 is intended to be connected to a tank (not shown) containing rinsing liquid. These two media, i.e. the glue and the rinsing liquid are under pressure so that each medium, in its associated inlet chamber 19 and 20 resp. is under a pressure of e.g. 6 bar. A rubber diaphragm 23 prevents the glue from reaching the outlet channel 21 and a second rubber diaphragm 24 prevents the rinsing liquid from reaching the outlet channel 22. Both diaphragms are spring loaded by a spring 25 and 26 resp. and actuatable by one piston 27 and 28 resp., which pistons constitute the movable parts of the electromagnets 15 and 16 resp. The pistons 27 and 28 are also spring loaded by springs 29 and 30 resp. The cumulative spring force of the springs 25, 29 and 26, 30 resp. is somewhat bigger than the pressure in the associated inlet chamber 19, 20, whereby the spring 25, 26 acting directly upon the diaphragm 23 and 24 resp. exerts a substantially higher pressure on the diaphragm than the spring 29 and 30 resp. provided in the piston 27 and 28 resp.

The piston stroke of the piston 27 is only some tenths of a millimeter, e.g. 0.2 mm, and the springs 25 and 29 are dimensioned in such a manner that the most essential closing force is obtained from the spring 25, whereas the spring 29 primarily has a re-setting function, i.e. it shall after actuation of the magnet 15 move the piston back to contact against the diaphragm 23. The punching effect on the diaphragm, which otherwise is common, i.e. that the impact of the piston on the diaphragm will damage this, is avoided in this manner.

The outlet channel 21 opens in a nozzle 31, which is provided with a very fine outlet opening 32, the diameter of which is chosen in respect of the desired width of the glue strip. If the outlet opening 32 is given a diameter of e.g. 0.3 mm a glue strip width of 2 mm is obtained at a paper track speed of 4–5 m/s.

As comparatively short glue strips shall be applicable (e.g. of 40 mm length at a paper speed of 10 m/s) it is necessary that the valve can be opened and closed a large number of times per second, which has been achieved in that the magnet coil 15, which is normally driven at 24 V, during a very short period of time, e.g. 2 milliseconds is driven at 170 V and thereafter is maintained at a holding current of 18 V. In this manner it is possible for the piston 27 to open up to 60 times per second.

For producing a glue strip having a distinct length and width it is preferable to use used a glue of rather low viscosity, which however gives the drawback that the glue during the closing periods may drip from the nozzle. For preventing this the outlet channel 22 for the rinsing liquid is connected to the outlet channel 21 for the glue via a Venturi-like restriction 33 so that a subpressure is generated in the outlet channel 22 at discharge of glue, which sub-pressure causes the fluid column in the outlet channel 21 to be sucked back slightly when the valve 13 is closed, thereby causing a pressure equalization in its channels and thereby preventing after-dripping.

Figure 3:
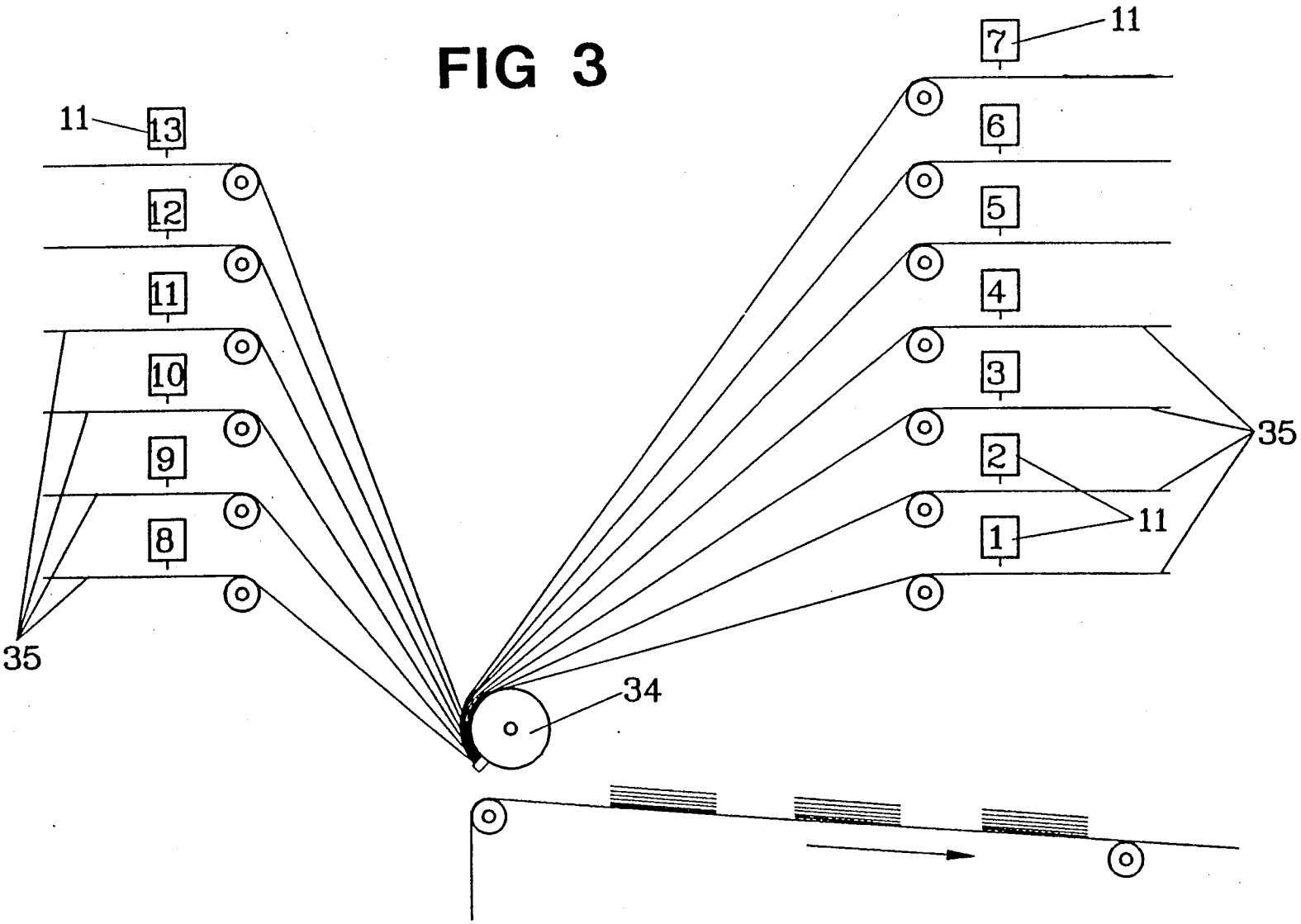
FIG. 3 shows a schematic overall view of how a plurality of glue sprayers according to the invention may be arranged.

When printing newspapers, periodicals, etc., as can be seen from FIG. 3 a glue spraying device 11 may be provided for each paper track, the width of which corresponds e.g. to a double sheet. Prior to the different tracks of paper being brought together on a common cylinder 34, where the tracks are cut to sheets, which form the final print, the desired lengths of glue strips are applied at a correct moment, which strips land on the paper track which travels past the nozzles 31 at a space therefrom. When the printed product is finished the rinsing valve 14 opens, which rinses the nozzle from glue and leaves a fluid pillar of rinsing liquid in the outlet channels of the valve housing, which prevents drying of the glue until the sprayer shall again be used.

I claim:

1. A device for application of a glue strip on a movable paper web, the means comprising at least one glue sprayer for spraying glue under pressure, a first and a second diaphragm-magnetic valve, a housing for the two diaphragm-magnetic valves;

first and second inlet chambers leading respectively into the first and second valves; first and second outlet channels leading respectively from the first and second valves;

a first and a second spring loaded rubber diaphragm between the first and second inlet chambers respectively, on the one hand, and the first and second outlet channels, respectively, on the other hand, the first chamber and the first valve being intended for glue and the second chamber and the second valve being intended for a rinsing liquid, the outlet channels being interconnected; and a common nozzle into which the outlet channels open, the nozzle having a fine outlet opening relatively closely spaced from a paper web;

the first and second magnetic valves having respective first and second pistons, the pistons of the magnetic valves acting upon the respective rubber diaphragms for urging the diaphragms to close the pathways from the first and second inlet chambers to the first and second outlet channels, respectively; each piston having a relatively very short stroke; the device eliminating late dripping at the nozzle and the nozzle being automatically cleaned after each glue application.

2. A device as claimed in claim 1, further comprising a respective spring acting between each diaphragm and the respective piston for urging the diaphragm to close the pathway between the respective inlet chamber and outlet channel.

3. A device as claimed in claim 2, wherein the respective spring force of the spring acting upon each diaphragm is lower than the pressure prevailing in the associated inlet chamber.

4. A device as claimed in claim 1, wherein the second outlet channel from the second inlet chamber (20) for the rinsing liquid is connected to the first outlet channel from the first inlet chamber for the glue via a Venturi restriction in the first outlet channel for the glue.

5. A device for applying a glue strip on a movable paper web, the device comprising:

a glue sprayer for spraying glue under pressure; the glue sprayer comprising a first and a second diaphragm-magnetic valve, and a common housing for the valves;

a first inlet chamber for glue, the first inlet chamber being an inlet chamber to the first valve; a second inlet chamber for rinsing liquid, the second inlet chamber being an inlet to the second valve;

first and second outlet channels leading respectively from the first and the second valves;

a first and a second spring loaded rubber diaphragm respectively between the first inlet chamber and the first outlet channel and between the second inlet chamber and the second outlet channel, and the first inlet channel being adapted for transmitting glue and the second outlet channel being adapted for transmitting a rinsing liquid;

the first and second outlet channels being interconnected; a common nozzle leading from the interconnected outlet channels, the nozzle having a fine outlet opening located relatively closely spaced from a paper web;

the first and second magnetic valves having respective first and second pistons, the pistons of the magnetic valves acting upon the respective first and second rubber diaphragms, each piston having a relatively short stroke for opening the communication between the respective inlet chamber and outlet channel, and the device being adapted for eliminating late glue dripping and the nozzle being automatically cleaned after each glue application.

* * * * *